US010841715B2

(12) United States Patent
Maennel

(10) Patent No.: US 10,841,715 B2
(45) Date of Patent: Nov. 17, 2020

(54) METHOD OF ADAPTING A HEARING APPARATUS

(71) Applicant: SIVANTOS PTE. LTD., Singapore (SG)

(72) Inventor: Tom Maennel, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 154 days.

(21) Appl. No.: 16/111,473

(22) Filed: Aug. 24, 2018

(65) Prior Publication Data

US 2019/0069099 A1 Feb. 28, 2019

(30) Foreign Application Priority Data

Aug. 25, 2017 (DE) ..... 10 2017 214 942

(51) Int. Cl.
*H04R 25/00* (2006.01)

(52) U.S. Cl.
CPC ..... *H04R 25/505* (2013.01); *H04R 25/70* (2013.01); *H04R 25/305* (2013.01); *H04R 25/552* (2013.01); *H04R 25/554* (2013.01); *H04R 2225/021* (2013.01); *H04R 2225/023* (2013.01); *H04R 2225/025* (2013.01); *H04R 2225/55* (2013.01)

(58) Field of Classification Search
CPC .... H04R 25/305; H04R 25/70; H04R 25/505; H04R 25/453; H04R 25/552; H04R 2205/041; H04R 2225/021; H04R 2225/025
USPC ..... 381/56, 58, 60, 312, 314, 315, 328, 330, 381/382
See application file for complete search history.

(56) References Cited

U.S. PATENT DOCUMENTS 4,677,675 A * 6/1987 Killion ..... H04R 25/48 381/322
5,303,306 A * 4/1994 Brillhart ..... H04R 25/558 381/312
7,587,052 B2 9/2009 Kasztelan
9,055,377 B2 6/2015 Kinsbergen et al.
9,210,522 B2 12/2015 Obradovic et al.
(Continued)

FOREIGN PATENT DOCUMENTS

CN 103404173 A 11/2013
DE 102004025122 A1 12/2005
(Continued)

*Primary Examiner* — Huyen D Le
(74) *Attorney, Agent, or Firm* — Laurence A. Greenberg; Werner H. Stemer; Ralph E. Locher

(57) ABSTRACT

A method adapts a hearing device. The hearing apparatus has a signal processing unit for processing an electrical input signal into an electrical output signal and a receiver for outputting an acoustic output signal based on the electrical output signal. Furthermore, the hearing apparatus has an individual sound transmission element with a frequency-dependent individual amplification profile for transmitting the acoustic output signal. The individual amplification profile is determined on the basis of a reference transfer function. The measured individual amplification profile is subsequently compared with a reference amplification profile of a reference sound transmission element, and the reference transfer function is adapted based on a difference between the individual amplification profile and the reference amplification profile.

17 Claims, 3 Drawing Sheets

(56) References Cited

U.S. PATENT DOCUMENTS

| | | | | |
|---|---|---|---|---|
| 9,271,666 | B2 | 3/2016 | Stirmann | |
| 2002/0176584 | A1 | 11/2002 | Kates | |
| 2005/0094822 | A1* | 5/2005 | Swartz ..... | A61B 5/121 381/56 |
| 2010/0098276 | A1 | 4/2010 | Frohlich et al. | |
| 2017/0350926 | A1 | 12/2017 | Cederberg et al. | |

FOREIGN PATENT DOCUMENTS

| | | | |
|---|---|---|---|
| DE | 102007035174 | A1 | 2/2009 |
| WO | 2012066149 | A1 | 5/2012 |
| WO | 2013075255 | A1 | 5/2013 |
| WO | 2016095987 | A1 | 6/2016 |

* cited by examiner

METHOD OF ADAPTING A HEARING APPARATUS

CROSS-REFERENCE TO RELATED APPLICATION

This application claims the priority, under 35 U.S.C. § 119, of German application DE 10 2017 214 942.6, filed Aug. 25, 2017; the prior application is herewith incorporated by reference in its entirety.

BACKGROUND OF THE INVENTION

Field of the Invention

The invention relates to a method for adapting a hearing apparatus.

Hearing devices in general are portable hearing apparatuses that are generally configured to output sound. "Sound" here generally signifies an acoustic signal, for example music and/or speech.

A "hearing apparatus" generally refers to any device which may be worn in or on the ear and produces a sound, for example a headset, headphones and the like. Hearing devices are, in addition, specially configured as hearing aids. "Hearing aid" refers to a device for the care of a person with hearing loss or a hearing impairment who, in particular, wears the hearing aid either continuously or most of the time in order to compensate for a hearing deficit.

To meet numerous individual requirements, different types of hearing devices are produced, such as behind-the-ear hearing devices (BTE), hearing device with external receiver (RIC: receiver in the canal) and in-the-ear hearing devices (ITE), for example Concha hearing aids or in-canal hearing devices (CIC). These hearing devices, listed by way of example, are worn on the outer ear or in the ear canal. In addition, bone conduction hearing aids, as well as implantable or vibrotactile hearing aids, are also available on the market. The damaged hearing is stimulated either mechanically or electrically.

Hearing devices generally have as their main components an input transducer, an amplifier and an output transducer. The input transducer is usually a sound receiver, e.g. a microphone, and/or an electromagnetic receiver, e.g. an induction coil. The output transducer is usually realized as an electro acoustic transducer, e.g. a miniature speaker, or as an electromechanical transducer, e.g. a bone conduction receiver. The amplifier is typically integrated into a signal processing unit. In addition, for example, an ITE hearing device often has a sound channel and a BTE device usually has a sound tube. In this case, the sound is transmitted to the user's eardrum by the sound tube, which is for example fastened in the ear canal with an earmold. In ITE devices, analogously to the sound tube in the BTE device, the sound channel serves to transmit sound from the receiver to an output of the housing, and thus toward the user's eardrum.

The user's hearing deficit and/or hearing impairment is often not uniformly severe over the user's entire frequency range of auditory perception. In other words, the user's hearing may be impaired, for example, only in a certain frequency range, or the hearing deficit and/or hearing impairment of the user may vary over the audible frequency spectrum (acoustic signals ranging in frequency from 20 Hz to 20 kHz).

The hearing device is adjusted, in particular adapted to the user, for example by means of a setting software, for example in the course of a fitting session at an acoustician.

In the setting, the hearing device, in particular the signal processing of the signal processing unit, is adjusted with regard to the user's hearing deficit and/or hearing impairment.

The sound tube often influences a transmission behavior of the hearing device. "Influence" here refers to a frequency-dependent attenuation and/or frequency-dependent amplification of the sound when it "traverses" the sound tube to the eardrum. This is taken into account when adapting the hearing device, for example based on a reference sound tube. The consideration based on the reference sound tube, however, is general, i.e. not user-specific; in consequence, for example, different lengths of sound tubes and in particular their influence on the transmission behavior are not taken into account, or are taken into account only insufficiently.

SUMMARY OF THE INVENTION

Proceeding from this, the objective of the invention is to specify a method by means of which a hearing apparatus may be user-specifically adapted at the least possible expense.

The objective is achieved according to the invention by a method having the features of the independent claim for adapting a hearing apparatus to an individual user. Advantageous configurations, developments and variants are the subject matter of the dependent claims.

"Hearing apparatus" here refers in particular to a hearing aid of the type already mentioned. Alternatively, "hearing apparatus" generally refers to a device for generating and outputting sound, for example like a headphone.

The hearing apparatus has a signal processing unit for processing an electrical input signal into an electrical output signal. The processing of the electrical input signal takes place here on the basis of a transfer function. This function is adapted to the individual circumstances of the hearing device wearer in a fitting process. The transfer function is typically a configurable and frequency-dependent reference transfer function. Here, "(reference) transfer function" generally signifies a mathematical function that describes the processing, for example convolution and/or in particular amplification, of the electrical input signal. "Configurable" here refers especially to the ability to adjust the parameters of the signal processing unit, by means of which the (reference) transfer function may be influenced, especially taking into account a hearing deficit and/or hearing impairment of the user. In other words: The signal processing unit may be set especially to an amplification of the electrical output signal that is individually tailored to the user, and is frequency-dependent in particular.

The hearing apparatus additionally has a receiver for outputting an acoustic output signal based on the electrical output signal. For this purpose, the receiver is preferably configured as an electro acoustic transducer of a type that is known in the art.

For transmitting the acoustic output signal, the hearing apparatus has an individual sound transmission element with a frequency-dependent individual amplification profile. "Individual" here refers to user-dependency of the sound transmission element, for example with regard to the length of the individual sound transmission element. In other words: for example, in ITE hearing devices, the length of the sound channel often varies, e.g. due to an individual and therefore distinctive configuration of the housing of the ITE device, which is due to a respective user's individual ear anatomy. The varying length of the sound channel often leads to unwanted frequency-dependent amplifications and/ or frequency-dependent attenuations of the output signal emitted by the receiver. As a result, the user's sense of hearing is impaired, because the user perceives sound with a certain frequency or in a frequency range to be either amplified or attenuated. The undesired amplification and/or attenuation of the sound within the sound channel is due, for example, to interference in the transmission of the output signal via the sound tube.

Due to different anatomies of users' ears, sound transmission elements that are individually adapted to the respective user are made with, for example, a length adapted to the user's ear canal.

Due to the different lengths, the different sound transmission elements have different frequency-dependent individual amplification profiles. "Individual amplification profile" here refers to an amplification that depends, in particular, on the frequency of the signal to be amplified, based on the interference occurring within the sound transmission element. The different frequency-dependent amplifications may be graphically represented, for example, by developing what is referred to as an "amplification curve," which "shows" the amplification profile.

Often, BTE hearing apparatus additionally has an earmold. The earmold is an earpiece which, for example, is specially adapted to the ear canal of the user in order to direct the acoustic output signal transmitted by the sound transmission element to the user's eardrum. For this purpose, the earmold is typically arranged at the end of the sound transmission element in the direction of the user's ear-drum.

The receiver and the individual amplification element preferably form an individual transmission system for the acoustic output signal. In this case, the individual transmission system takes into account, for example, individual types of receivers, individual acoustic couplings of the receiver to the (individual) sound transmission element, and in general, acoustic tolerances of the receiver and/or the individual sound transmission element. These aspects affect the individual amplification profile.

However, due to the fact that the individual amplification profile substantially depends on the individual sound transmission element, only the individual sound transmission element will be discussed below, with reference to the individual amplification profile.

To adapt the hearing apparatus, the individual amplification profile is determined and stored for a subsequent fitting process. "Fitting process" here generally refers to adapting the hearing device, in particular the reference transfer function, to the individual user.

As a result, a user-dependent adaptation of the hearing apparatus is achieved in particular, in order to compensate as well as possible for a hearing deficit of the user.

According to a preferred configuration, to adapt the hearing apparatus to the individual amplification profile of the individual sound transmission element, the individual amplification profile of the individual sound transmission element is measured relative to, in particular, a predetermined and known reference transfer function. This means that the hearing device is furnished with an individual sound transmission element. An electrical input signal is input. This signal is converted based on the reference transfer function to the electrical output signal, and that signal is then converted to the acoustic output signal by the receiver and individual sound transmission element. This is measured, so that the individual amplification profile is obtained or may be determined, and thus measured, based on the measured acoustic output signal.

This reference transfer function corresponds in particular to a standard or reference preset of the respective hearing device before it is individually adapted to the respective hearing device wearer. The reference transfer function is for example pre-installed on the hearing device or stored in a setting unit (software).

The measurement of the individual amplification profile of the individual sound transmission element is preferably carried out at the factory or by the manufacturer, for example in the course of a final inspection of the hearing devices by the manufacturer. In this case, for example, the measured individual amplification profile is also stored, in order to make it available at a later time. "Later point in time" generally refers to all times after the individual amplification profile is measured and especially refers, for example, to a fitting session at an acoustician in the course of the hearing device being handed over to the customer. This makes it possible to initially determine an individual amplification profile of the individual sound transmission element at the factory and store it, for example, retrievably in a database, making it available irrespective of location to an acoustician for adapting the hearing apparatus during a fitting process.

The measured individual amplification profile is then compared to a reference amplification profile, which was preferably determined based on the same (reference) transfer function. The reference amplification profile describes the amplification behavior of a reference system (a reference transmission system, in particular a reference receiver and reference sound transmission element), which in particular has a reference sound transmission element with a predetermined reference length.

The measurement of the individual amplification profile on the basis of the reference transfer function and optionally also the comparison with the reference amplification profile are in particular carried out at the factory.

In this case, the individual amplification profiles are preferably measured and stored for a multiplicity of individual transmission systems, optionally together with the optionally determined differences from the reference amplification profile.

The reference transfer function, which describes the processing of the electrical input signal "within" the signal processing unit, is then set and in particular adapted, for example parameterized, as a function of a difference between the two amplification profiles (the individual amplification profile and reference amplification profile). In this way, the reference transfer function is adapted and an (adapted) transfer function is obtained, with which the electrical input signal is then converted into the electrical output signal. This adapted transfer function thus takes into account the individual boundary conditions, and is also referred to below as an individual transfer function. In particular, this function takes into account the individual amplification profile of the individual (user-specific) sound transmission element.

This adaptation preferably takes place during the fitting process, for example at an acoustician. The particular advantage is that the acoustician only needs to access the difference values that were determined and stored by the manufacturer. The fitting process is therefore comparatively simple. In other words, it is only necessary to determine the individual transmission system, in particular, for example, to retrieve just the individual length of the sound transmission element and the data stored for this purpose, and input that into in a fitting software.

"Reference sound transmission element" here generally refers to a sound trans-mission element having a known amplification profile, the reference amplification profile. The reference amplification element is additionally part of the reference system, which for example has known parameters based on empirical values. "Parameters" here generally signify properties of the reference system, for example the reference amplification profile of the reference sound transmission element and/or a predetermined and known length of the reference sound transmission element. In this context, the reference system should be understood to be a specifically non-individual system and thus the reference sound transmission element and/or the reference sound transmission path should be understood as non-individual.

In other words: The reference amplification profile serves in particular as a non-individual reference value for comparing the values of an actual amplification of the individual amplification profile by the individual sound transmission element with the reference amplification profile of the reference sound transmission element. The reference amplification profile is thus the same for each comparison, while the individual amplification profile of the individual sound transmission element varies from user to user. The individual amplification profile applies when the individual sound transmission element is arranged on the hearing apparatus, for example instead of the reference sound transmission element.

For example, the individual sound transmission element has an individual amplification profile, which—over the entire hearing spectrum of the user or over a certain frequency range—effects an additional amplification of the acoustic output signal by, for example, 10 dB. With a reference transfer function that has not been adapted, the user now undesirably perceives the acoustic output signal more intensely due to the additional amplification of 10 dB, leading to a lasting interference with a desired auditory impression. Analogously, the individual sound transmission element may also lead to attenuation of the acoustic output signal via the individual amplification profile.

The 10 dB determined in the context of the comparison now serves as a difference and as an adaptation value of the reference transfer function, in that the electrical output signal of the signal processing unit is attenuated by 10 dB in the affected frequency ranges by means of the adapted reference transfer function. In other words, the acoustic output signal based on the electrical output signal is amplified by the amplification of the acoustic output signal by 10 dB that occurs within the individual sound transmission element, so that the user perceives the desired auditory impression and the hearing apparatus operates without interference.

In addition, as already described, the adaptation does not take place exclusively for individual frequencies. Rather, an adaptation with regard to a frequency-dependent individual amplification profile of the individual sound transmission element is achieved by means of the described method. In other words, due to different frequency-dependent additional amplifications of the acoustic output signal based on the individual amplification profile, preferably, the reference transfer function is adapted with regard to the entire individual amplification profile.

The advantage is in the fact that an adaptation of the transmission behavior of the hearing device is achieved by adapting the reference transfer function and thus the hearing apparatus to an individual sound transmission element—in particular to the individual amplification profile thereof. In particular, the adaptation is achieved with regard to at least a reduction the interference in the acoustic output signal arising within the individual sound transmission element. By at least reducing such interference, above all, the hearing apparatus is user-specifically adapted to user-specific individual sound transmission elements. "Interference" here refers in particular to acoustic overlays and/or resonances. Experimental measurements have shown, for example, that interference-related amplifications have a value of up to 5 dB in a frequency range from 400 Hz to 1300 Hz and up to 20 dB in a frequency range from 4 kHz to 6 kHz.

Analogously, if the individual sound transmission element causes undesired attenuation of the acoustic output signal, an unwanted attenuation of the acoustic output signal is adapted to by an additional amplification within the signal processing unit.

According to a preferred configuration, the reference transfer function is adapted by means of setting software. The setting software is preferably stored on, or loaded from, a setting unit. Such a setting unit may be, for example, a computer set up for adapting and setting the hearing apparatus. The setting unit is used for the fitting process, i.e. for adapting the reference transfer function, for example at the acoustician. The adaptation of the reference transfer function takes place, for example, by a wired or preferably wireless connection between the hearing apparatus and the setting unit.

The setting software is by default set to a reference transfer function based on the reference amplification profile. For this purpose, the reference amplification profile is preferably implemented in the setting software as part of a factory pre-setting, done for example in the course of a final inspection of the hearing device. Alternatively, the reference amplification profile is stored, for example, in a database.

The advantage is that the setting software enables a simple implementation and adaptation of the reference transfer function. Furthermore, a reduction of development costs is achieved because the reference amplification profile may be implemented, for example, in a conventional standard adaptation software.

Preferably, only extrema and inflection points are stored as data pairs for the individual amplification profile. These points are extracted, for example, from the individual amplification profile. "Data pair" here refers especially to a coordinate of the individual amplification profile of a kind known in the art, which has both a frequency value and an associated amplification. As a result, overloading of a storage space is prevented, because characteristic data pairs, such as the already mentioned local extreme values and inflection points, are extracted for storage only over the range of the individual amplification profile.

According to an expedient development, only a maximum of 20, preferably a maximum of 10, and in particular 8, data pairs are stored for a frequency spectrum that is audible to the user and for the individual amplification profile.

The determination and storage of the data pairs is preferably done by the manufacturer.

The data pairs are preferably stored in a database, for example in cloud storage. This makes it possible to guarantee access to the data pairs from different locations and in particular, for example, by different acousticians. In addition, this enables straightforward editing of the data pairs. Alternatively or additionally, each hearing apparatus has, for example, a memory element on which the data pairs are stored.

Alternatively or additionally, the data pairs are coded and in particular stored as a graphic code. This is particularly accessible to the user, for example, when it is mounted on a packaging of the hearing apparatus or stored in an operating manual or similar that is associated with the hearing device or, for example, retrievable as a graphical code from a website. "Graphical code" here refers especially to, for example, a visible coding in the manner of a bar code or a QR code.

In a preferred embodiment, prior to comparing the individual amplifier profile with the reference amplifier profile, the individual amplification profile is reconstructed from the data pairs, so that the entire frequency-dependent individual amplification profile is used for comparison by means of the setting software.

For the measurement of the individual amplification profile (typically at the manufacturer), as explained above, the procedure is typically conducted in such a way that the signal processing unit outputs an electrical reference output signal. The reference output signal that has been output is then transduced by the receiver into an acoustic output signal. The acoustic output signal is then measured at the end of the individual sound transmission element arranged on the receiver. The reference output signal is generated, for example, either based on the input of a predetermined acoustic reference input signal into the signal processing unit—for example by means of a tone generator that generates a signal that may be parameterized into frequency and amplitude—or alternatively by the signal processing unit itself. For example, an amplification and/or a maximum output level from which the individual amplification profile is generated are used as parameters of the reference output signal that are to be measured. "Electrical reference output signal" here refers to an electrical signal that, for example, has a predetermined, and in particular constant, sound level over a predetermined frequency range.

In a preferred development, the individual amplification profile is reconstructed with the aid of the setting unit. The reconstruction takes place, for example and preferably, in the course of a fitting session at an acoustician. This allows a simple implementation of the individual amplification profile in the setting software. During reconstruction, the individual amplification profile is preferably determined without the user. In other words, the user does not wear the hearing apparatus during measurement. The acoustician obtains the data pair required for the reconstruction from the database and/or by decoding for example the graphical code printed on the packaging of the hearing apparatus.

After the individual amplifier profile has been reconstructed in and by means of the setting software, the setting software compares the reference amplifier profile with the reconstructed individual amplification profile. A difference of the two profiles then serves to adapt the reference transfer function of the signal unit, which is likewise adapted and/or adjusted by the setting software. The adaptation of the reference transfer function takes place in the above-mentioned manner, for example by "adding" the differential amplification to the reference amplification profile. As a result, in particular, an authentic hearing impression is also achieved for the user in the case of an individual sound transmission element.

After adapting the reference transfer function, the setting software parameterizes the signal processing based on the adapted reference transfer function. The parameterization takes place, for example, by means of the above-described wire-less connection between the setting unit and the hearing apparatus. "Parameterization" here refers especially to an adjustment of the signal processing unit by means of the adapted reference transfer function.

The advantage here is that already-existing units and/or software are used for adapting the adapted reference transfer function and subsequently parameterizing the signal processing unit, and are only extended by a function for adapting the reference transfer function and parameterizing the signal processing unit. As a result, cost advantages are also achieved, in particular with regard to development costs.

According to a preferred configuration, the sound transmission element is designed as a sound channel. Such sound channels are often arranged on hearing apparatus for transmitting an acoustic signal.

The individual length of the sound transmission element preferably has a user-dependent value in the range from 2 mm to 20 mm. As a result, the sound trans-mission element may be produced for the user in an individual and user-dependent way.

According to an expedient configuration, the hearing apparatus is designed as a hearing aid, in particular as an ITE hearing aid. Such ITE hearing aids are available on the market as either wireless or non-wireless devices. "A wireless device" here refers to a hearing aid that has two hearing aid sub devices (one subunit per ear of the user), which preferably has wireless connections, for example to a setting unit, or alternatively between the hearing aid sub devices, for example to form binaural signals. Analogously, "a non-wireless device" here refers to a hearing aid that specifically is not designed for communication by means of a wireless connection.

The described method may be transferred analogously in particular to both wireless and non-wireless devices. This transfer is based on the consideration that wireless devices, in particular wireless ITE devices from the factory, for example, have a longer sound transmission element than, for example, non-wireless ITE devices. The longer sound transmission element in wireless devices results, for example, from an antenna element arranged on the wireless device, this antenna element being arranged around the sound transmission element in the manner of a coil antenna. Thus, the sound transmission elements of the wireless devices and non-wireless devices also have length differences, and in particular each respectively shows a different frequency-dependent amplification profile. In an exemplary conversion of a non-wireless device to a wireless device, the above-described method may be used to at least reduce the deviations occurring in the manner above described. In general, the method described may be applied to all hearing device variants which, for example due to design, have different lengths of the individual sound transmission element. As a result, in particular an advantage is achieved with regard to simplified development.

The method described herein is characterized in particular by the following steps:

a) the individual amplification profiles are measured by the manufacturer or factory for a multiplicity of individual transmission systems;

b) these profiles, or preferably only extracted data pairs, are stored in a database, in particular in a cloud;

c) during a fitting process, for example at the acoustician, the individual transmission system furnished for a respective hearing device wearer (user) is determined, particularly the individual length of the sound transmission element;

d) for the individual transmission system, the individual amplification profile or data pairs stored for that purpose are retrieved;

e) optionally, the individual amplification profile is reconstructed from the data pairs;

f) the individual amplification profile is compared with the reference amplification profile stored for example in the setting unit, and (frequency-dependent) differences are determined (with the aid of the setting unit); and g) the reference transfer function is adapted/parameterized based on these differences, yielding an individual transfer function that takes into account the individual sound transmission behavior of the individual sound trans-mission element.

Other features which are considered as characteristic for the invention are set forth in the appended claims.

Although the invention is illustrated and described herein as embodied in a method of adapting a hearing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
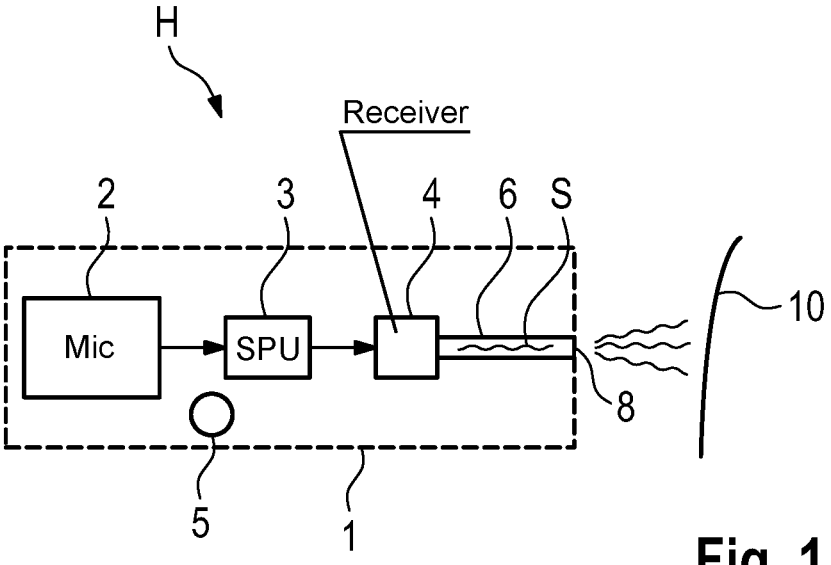
FIG. 1 is an illustration of a simplified structure of a hearing apparatus configured as an ITE hearing device.

In the drawings, parts having the same effect are represented by the same reference numerals.

Referring now to the figures of the drawings in detail and first, particularly to FIG. 1 thereof, there is shown a simplified and roughly sketched structure of a hearing apparatus H configured as an ITE hearing device. An "ITE hearing device" in the exemplary embodiment refers to a hearing device arranged at least partially, and in particular completely, inside the ear canal of a user.

In the exemplary embodiment, the ITE hearing device has a hearing device housing 1, a microphone 2 for recording and transducing an acoustic input signal into an electrical input signal, and a signal processing unit 3. The signal processing unit 3 is used for converting, and in particular amplifying, the electrical input signal into an electrical output signal. In addition, the ITE hearing device has a battery 5 for supplying electrical power.

The ITE hearing device additionally has a receiver 4 for transducing the electrical output signal into an acoustic output signal S and outputting the acoustic output signal. At the end of the receiver 4, a sound transmission element 6 is arranged, for example a sound tube of a type known in the art. The sound transmission element 6 serves to transmit the acoustic output signal from the receiver 4 to a user's eardrum 10. This configuration is based on the consideration that, in particular in ITE hearing devices, the receiver 4 is usually not arranged directly on the hearing device housing 1. The position of the receiver 4 inside the hearing device housing 1 will vary depending on an individual hearing device housing 1 that is adapted to the user's ear. However, in order to transmit the acoustic output signal from the receiver 4 to an output 8 of the hearing device housing 1, the sound transmission element 6 is typically arranged between the receiver 4 and the output 8.

The sound transmission element 6 has, for example, a user-specific length with a value in the range from 2 mm to 20 mm. Analogously, sound transmission elements 6 having different lengths also each have different amplification profiles of the acoustic output signal that is transmitted through them.

In the exemplary embodiment, the receiver 4 and the individual sound transmission element 6 form an individual sound transmission system.

Figure 2:
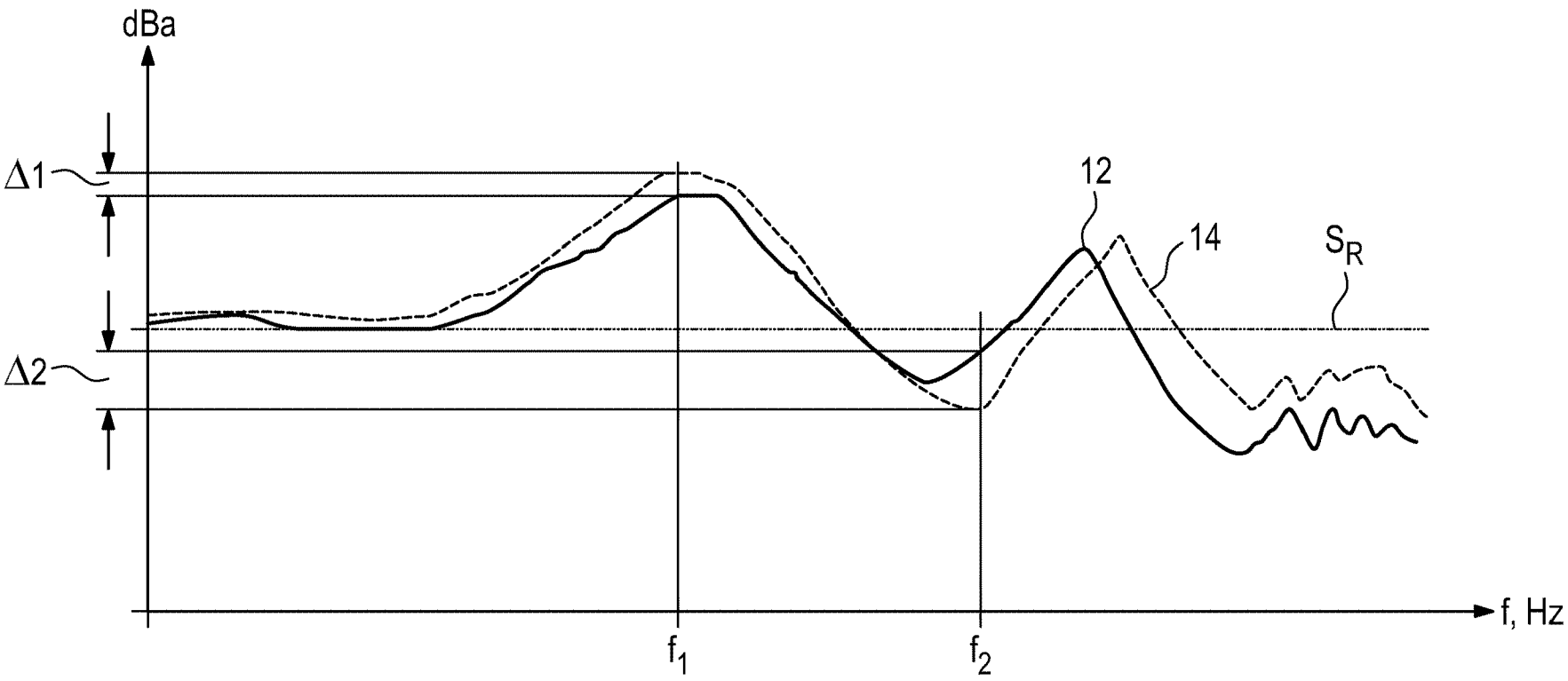
FIG. 2 is a graph of two different amplification profiles.

In FIG. 2, two such amplification profiles 12, 14 are sketched as functions of the frequency f. In the exemplary embodiment, the frequency f is plotted logarithmically on the abscissa X. On the ordinate axis Y, the amplification in decibels is indicated acoustically (dBa).

In the exemplary embodiment, a reference amplification profile 12 (amplification of an acoustic output signal in transmission via a reference sound transmission element) and, on the other hand, an individual amplification profile 14 (amplification of an acoustic output signal in transmission via an individual, user-specific sound transmission element) are both plotted as a function of the frequency f. The profiles 12, 14 shown serve to illustrate and explain a frequency difference for adapting a reference transfer function of the signal processing unit 3. In addition, FIG. 2 shows the profile of a reference signal SR that is input into the signal processing unit on the input side. In the exemplary embodiment, the input reference signal SR has a constant sound level over the entire frequency spectrum. Frequency-dependent differences, for example between the reference signal SR and the individual amplification profile 14, are used to determine the individual amplification profile 14 in the above-described manner.

In the exemplary embodiment, the individual amplification profile 14 has a first amplification difference Δ1 from the reference amplification profile 12 at a first frequency f1. At a second frequency f2, the individual amplification profile 14 has a second amplification difference Δ2 from the reference amplification profile 12. Here, the two amplification differences Δ1, Δ2 differ in their amplification. In other words, when the acoustic output signal is input into the individual sound transmission element 6 at the frequency f1, it is amplified by the value Δ1 when transmitted via the individual sound transmission element 6 (compared to transmission via the reference sound transmission element). Analogously, the acoustic output signal, if it is input into the individual sound transmission element 6 with frequency f2, is attenuated by the value Δ2 (compared to transmission via the reference sound transmission element).

The same one acoustic output signal is fed into both sound transmission elements (the reference sound transmission element and individual sound transmission element) by the signal processing unit, so that the amplification differences arise exclusively through, for example, the different lengths of the sound transmission elements. In addition, the two sound transmission elements (reference sound transmission element and individual sound transmission element), for example, also differ in their material, shape and/or cross section.

In the event of a mismatch within the transfer function of the signal unit, such amplification differences Δ1, Δ2 lead to undesired interference in the acoustic output signal that disturbs the user.

Figure 3:
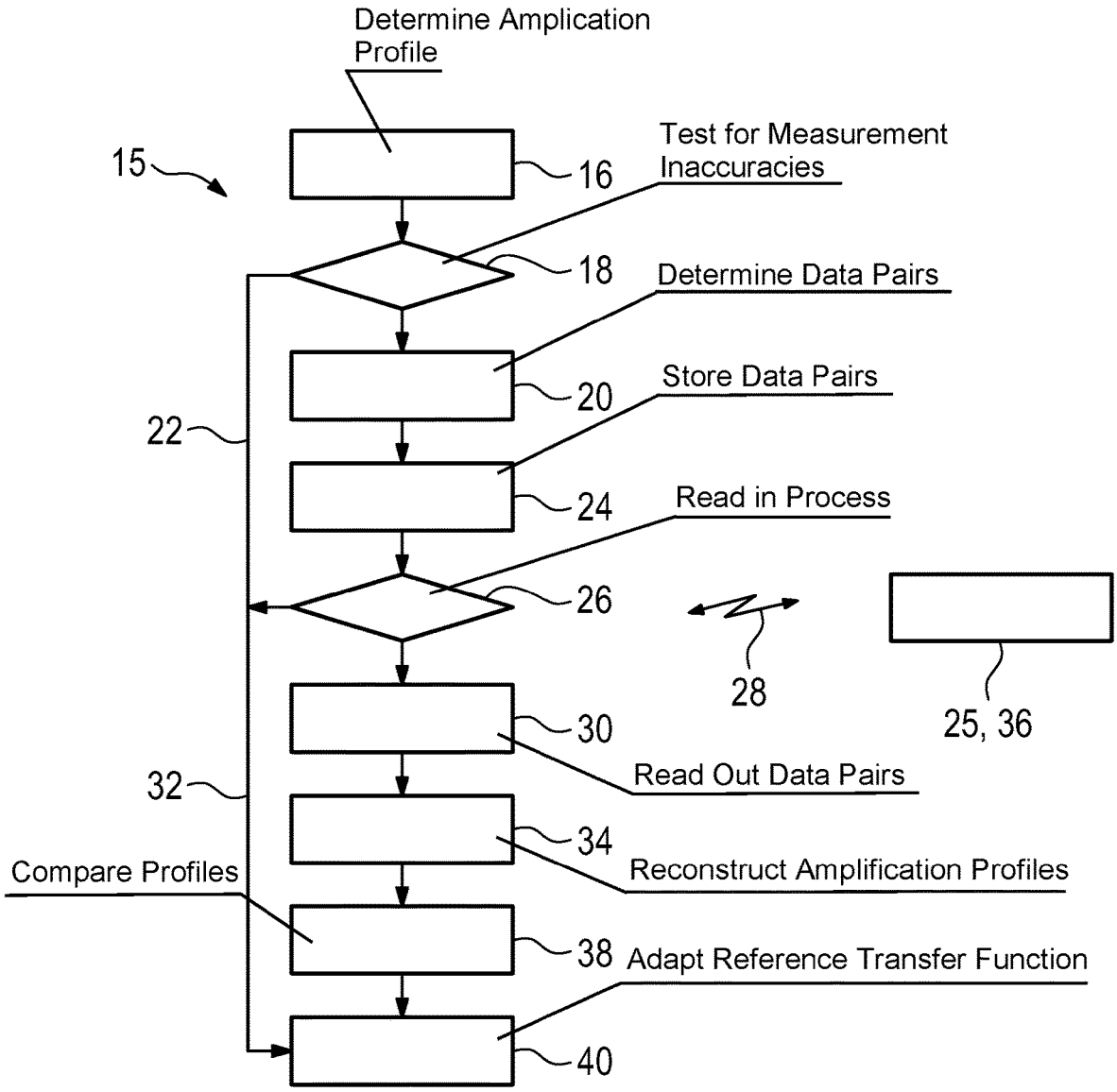
FIG. 3 is a flow chart showing method steps of the invention.

To assist with a detailed understanding, the method steps are again portrayed in FIG. 3 by means of a roughly outlined block diagram, based on the basic idea of the method 15 in the exemplary embodiment.

In order to determine a reference amplification profile 12 of the hearing device H, the reference amplification profile 12 is determined, for example, on the basis of empirical values with regard to, for example, an expected average value for the length of the individual sound transmission elements 6 that were prepared for the hearing apparatus H. For this purpose, a reference sound transmission element is used that, for example, has such an average length. The reference amplification profile 12 is then stored, for example, in a database.

The individual amplification profile 14 is determined 16, for example, in the course of a final inspection after the hearing apparatus H has been manufactured. For this purpose, for example, a predetermined electrical input signal, for example the reference signal SR, is input into the signal processing unit 3. The individual amplification profile 14 of the acoustic output signal that is output at the end of the individual sound transmission element 6 is detected.

As part of a subsequent test 18 of the individual amplification profile 14 that has been determined, this profile is reviewed for measurement inaccuracies or disturbances. For example, disturbances and/or deviations, e.g. due to faulty positioning of the hearing apparatus H within a measuring chamber, often occur during determination of the individual amplification profile 14.

If the individual amplification profile that has been determined passes the test positively (i.e. no unacceptable deviations occurred) the data pairs of the detected individual amplification profile are determined, for example, by extracting relevant data pairs 20. "Relevant data pairs" here refer to the characteristic coordinates of a profile, for example local maxima and/or minima or inflection points.

In the exemplary embodiment, for example, in the present case a maximum of 20, and in particular a maximum of 8, data pairs are extracted.

In the event of a negative test result (i.e. one in which the deviations are unacceptable or the measurement was completely erroneous), data pairs are not extracted 22.

The extracted data pairs are then stored 24. They are stored for example in a database. In particular, the database is set up as a cloud storage so as to ensure location-independent and/or time-independent access to the data pairs. Alternatively, the data pairs are stored, for example, within the hearing device by means of an internal memory element or are printed by means of a graphic coding, for example on the packaging of the hearing apparatus H. "Graphic coding" here refers, for example, to a bar code of a kind known in the art, or a QR code.

In the exemplary embodiment, the reference transfer function on the basis of which the signal processing unit 3 processes the electrical input signals into electrical output signals is set up based on the data pairs of the reference amplification signal that were stored (as already mentioned) in the course of development.

In the exemplary embodiment, the described method steps 16, 18, 20, 22, and 24 are carried out in particular at the factory. In other words, the detection of the individual amplification profile and the extraction and storage of the data pairs takes place, for example, in the course of a final inspection of the hearing device when it is manufactured.

An adaptation of the reference transfer function of the signal processing unit 3 to an individual amplification profile 14 of an individual sound transmission element 6 takes place, for example, in the course of a fitting session at the acoustician.

For this purpose, for example, a process is carried out of reading in the hearing device by means of a setting unit 25, such as a computer, with regard to a test of whether data pairs have been stored 26 for the hearing apparatus H and in particular for the arranged individual sound transmission element 6. The read-in process takes place, for example, by means of a wireless connection 28.

In the case of a positive test, i.e. a test in which data pairs are present for the individual sound transmission element 6, for example in the aforementioned database, the stored data pairs are read out 30 from the database. Alternatively, the data pairs are determined by decoding the graphical code on the packaging of the hearing apparatus H.

In the case of a negative test, i.e. a test in which no data pairs are stored for the individual sound transmission element or the hearing apparatus H has no individual sound transmission element 6, the reference transfer function of the signal processing unit is not adapted with regard to an individual amplification profile 14; rather, the setting unit 25 uses the data pairs of the reference amplification profile 12 to set up the reference transfer function 32.

After the readout of the data pairs of the individual amplification profile 14, the setting unit reconstructs 34 the individual amplification profile 14 using the stored data pairs, for example by means of a setting software 36.

The two profiles 12, 14 that have been determined or reconstructed are now compared to one another 38 with regard to a difference in amplification behavior. In other words: By comparing the two profiles 12, 14, the setting software 36 determines to what extent the individual amplification profile deviates from the reference amplification profile 12 with regard to the amplification. This difference is determined here, for example, for a frequency band in the audible range of humans (20 Hz to 20 kHz), so that a difference between the two profiles 12, 14 is determined e.g. for each audible frequency. In this way, the difference is used for adapting the reference transfer function over a particular frequency band. The background of this determination is that the difference in the amplification of the two profiles 12, 14 varies in particular frequency-dependently.

To adapt 40 the reference transfer function of the signal processing unit 3, the previously-determined difference is "added" to the reference transfer function by means of the setting software 36. In other words, the reference transfer function is adapted by means of the setting software in such a way that it generates an electrical output signal based on the frequency, and this signal differs from the preset electrical output signal by the value and sign of the difference. Thus, a too heavily amplified or weakly amplified electrical output signal is for example deliberately output by the signal processing unit 3, and after transduction in the receiver an acoustic output signal S is output, and this signal is amplified or attenuated based on the individual amplification profile 14 of the individual sound transmission element 6, in such a way that the user hears the desired output signal.

The following is a summary list of reference numerals and the corresponding structure used in the above description of the invention:

1 Hearing device housing
2 Microphone
3 Signal processing unit
4 Receiver
5 Battery
6 Sound transmission element

8 Output of the hearing device housing
10 Eardrum
12 Reference amplification profile
14 Individual amplification profile
15 Method for adapting a hearing apparatus
16 Determination of the reference amplification profile
18 Inspection of the reference amplification profile
20 Negative test: extraction of data pairs
22 Positive test: no extraction of data pairs
24 Storage of data pairs
25 Setting unit
26 Testing of stored data pairs for the individual sound transmission element
28 Wireless connection
30 Read-out of data pairs
32 Setup of the reference transfer function using the reference amplification profile
34 Reconstruction of individual amplification profile from the data pairs
36 Setting software
38 Calculation of difference between the individual amplification profile and the reference amplification profile
40 Adaptation of reference transfer function to individual amplification profile
dBa Acoustic amplification
H Hearing apparatus
S Acoustic output signal
SR Reference signal
f Frequency
f1 first frequency
f2 second frequency
Δ1 first amplification difference
Δ2 second amplification difference
X Abscissa
Y Ordinate axis

The invention claimed is:

1. A method for adapting a hearing apparatus, the hearing apparatus having a signal processing unit for processing an electrical input signal into an electrical output signal based on a transfer function, a receiver for outputting an acoustic output signal based on the electrical output signal and an individual sound transmission element connected to the receiver, the receiver and the individual sound transmission element forming an individual transmission system with a frequency-dependent individual amplification profile for the acoustic output signal, which comprises the steps of:

determining the frequency-dependent individual amplification profile;

storing the frequency-dependent individual amplification profile for a subsequent fitting process, wherein storing only extrema and inflection points of the frequency-dependent individual amplification profile as data pairs; and reconstructing the frequency-dependent individual amplification profile before comparing the data pairs.

2. The method according to claim 1, which further comprises:

measuring the frequency-dependent individual amplification profile based on a reference transfer function, wherein:

the frequency-dependent individual amplification profile is compared with a reference amplification profile; and to obtain the transfer function, a reference transfer function is adapted based on a difference between the frequency-dependent individual amplification profile and the reference amplification profile.

3. The method according to claim 2, wherein an adaptation takes place by means of setting software stored on a setting unit, which is by default set to the reference transfer function based on the reference amplification profile.

4. The method according to claim 3, which further comprises reconstructing the frequency-dependent individual amplification profile by means of the setting unit.

5. The method according to claim 3, wherein the setting software adapts the reference transfer function based on the difference.

6. The method according to claim 3, wherein the setting software parameterizes the signal processing unit based on an adapted reference transfer function.

7. The method according to claim 1, wherein only a maximum of 20 of the data pairs are stored for an audible frequency spectrum and the frequency-dependent individual amplification profile.

8. The method according to claim 1, which further comprises storing the data pairs in a database.

9. The method according to claim 1, which further comprises storing the data pairs in a server-based memory.

10. The method according to claim 1, which further comprises encoding the data pairs.

11. The method according to claim 1, wherein the sound transmission element is a sound channel and an individual length of the sound transmission element varies user-dependently in a range from 2 mm to 20 mm.

12. The method according to claim 1, wherein the hearing apparatus is a hearing aid.

13. The method according to claim 1, wherein only a maximum of 10 of the data pairs are stored for an audible frequency spectrum and the frequency-dependent individual amplification profile.

14. The method according to claim 1, which further comprises storing the data pairs in a cloud based memory.

15. The method according to claim 1, which further comprises encoding the data pairs with a graphic code.

16. The method according to claim 1, wherein the hearing apparatus is an in the ear hearing aid.

17. A method for adapting a hearing apparatus, the hearing apparatus having a signal processing unit for processing an electrical input signal into an electrical output signal based on a transfer function, a receiver for outputting an acoustic output signal based on the electrical output signal and an individual sound transmission element connected to the receiver, the receiver and the individual sound transmission element forming an individual transmission system with a frequency-dependent individual amplification profile for the acoustic output signal, which comprises the steps of:

determining the frequency-dependent individual amplification profile;

storing the frequency-dependent individual amplification profile for a subsequent fitting process;

measuring frequency-dependent individual amplification profiles by a manufacturer for a multiplicity of individual transmission systems;

extracting data pairs that characterize a profile from the frequency-dependent individual amplification profiles and the data pairs are stored in a database;

during a fitting process at an acoustician, determining an individual length of the individual sound transmission element provided for a respective hearing device wearer;

retrieving stored data pairs for an individual transmission system;

reconstructing the frequency-dependent individual amplification profile from the data pairs;

comparing the frequency-dependent individual amplification profile with a stored reference amplification profile by means of the setting unit, and differences are determined; and adapting the reference transfer function based on the differences, so as to obtain an individual transfer function that takes into account individual sound transmission behavior of the individual sound transmission element.

* * * * *